US005330086A

United States Patent [19]

Shimomura et al.

[11] Patent Number: 5,330,086

[45] Date of Patent: Jul. 19, 1994

[54] ELECTROMOTIVE STAPLER

[75] Inventors: Shigehiko Shimomura, Moriyama; Tadayuki Haruyama, Osaka, both of Japan

[73] Assignee: Matsushita Electric Industrial Co., Ltd., Kadoma, Japan

[21] Appl. No.: 951,100

[22] Filed: Sep. 25, 1992

[30] Foreign Application Priority Data

Sep. 26, 1991 [JP] Japan ..... 3-247267

[51] Int. Cl.[5] ..... B25C 1/06; B27F 7/36

[52] U.S. Cl. ..... 227/007; 227/153; 227/155

[58] Field of Search ..... 227/7, 153, 120, 129, 227/155, 131

[56] References Cited

U.S. PATENT DOCUMENTS

| | | | |
|---|---|---|---|
| 3,666,157 | 5/1972 | Kawai et al. | 227/155 |
| 4,186,863 | 2/1980 | Yunoki | 227/155 |
| 4,199,095 | 4/1980 | Yamanoi . | |
| 4,344,554 | 8/1982 | Cross | 227/155 |
| 4,720,033 | 1/1988 | Olesen | 227/155 |
| 4,726,505 | 2/1988 | Okazaki . | |
| 4,830,256 | 5/1989 | Kramer | 227/155 |
| 5,007,572 | 4/1991 | Chung-Cheng | 227/7 |
| 5,195,671 | 3/1993 | Shimomura et al. | 227/7 |

*Primary Examiner*—Scott Smith
*Attorney, Agent, or Firm*—Ratner & Prestia

[57] ABSTRACT

An electromotive stapler according is provided with a paper holder, which is linked with a striking block, to press the neighborhood of the place where the staple is driven, whereby binding of many sheets of paper is possible without consuming much power of the motor, the pressing force of the paper holder being obtained by motion of push rod to press the paper holder, and the force of push rod necessary therefor being obtained by a coil spring compressed by the motion of the striking block.

9 Claims, 4 Drawing Sheets

FIG. 6
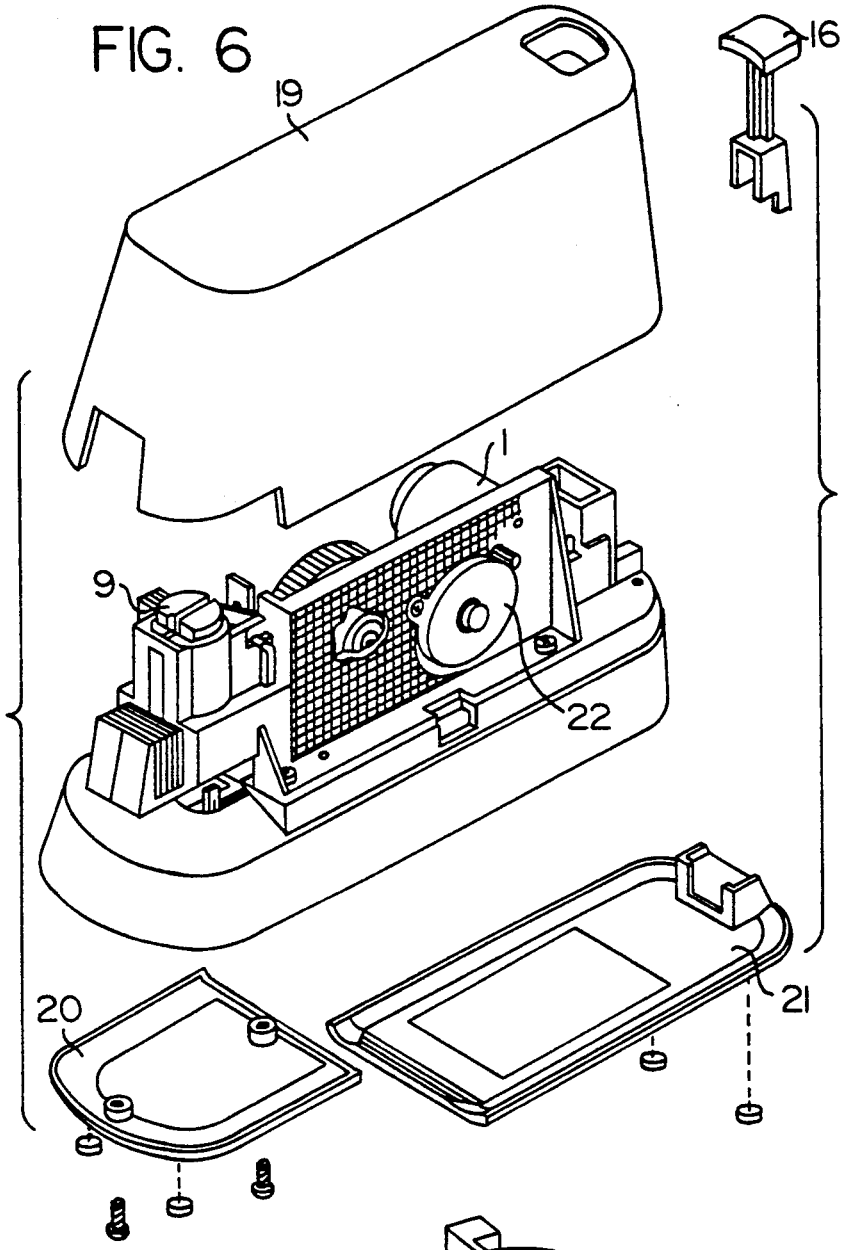
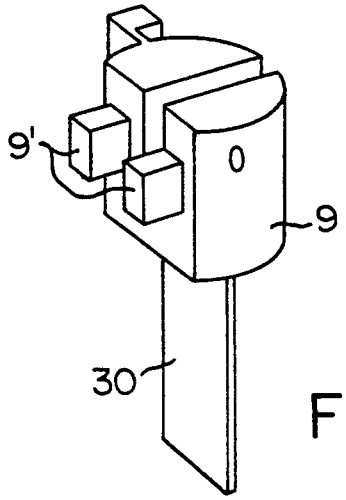
FIG. 7

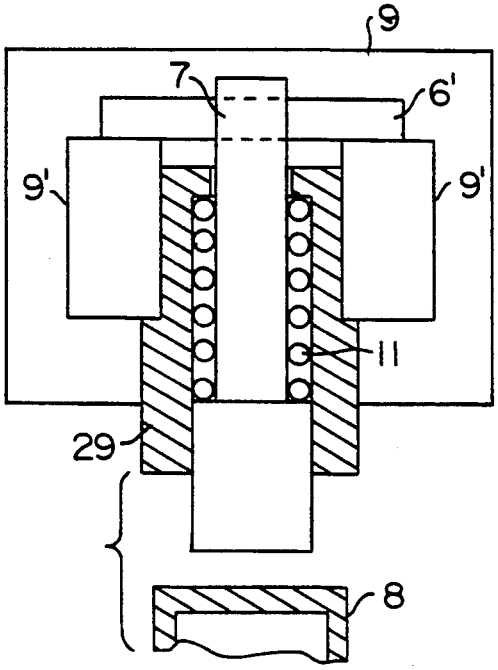
FIG. 8a
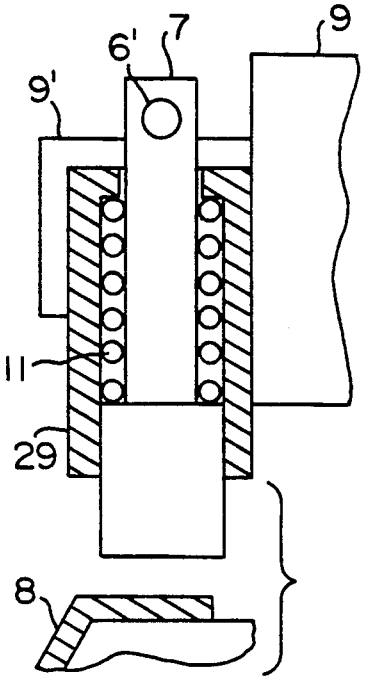
FIG. 8b
FIG. 9
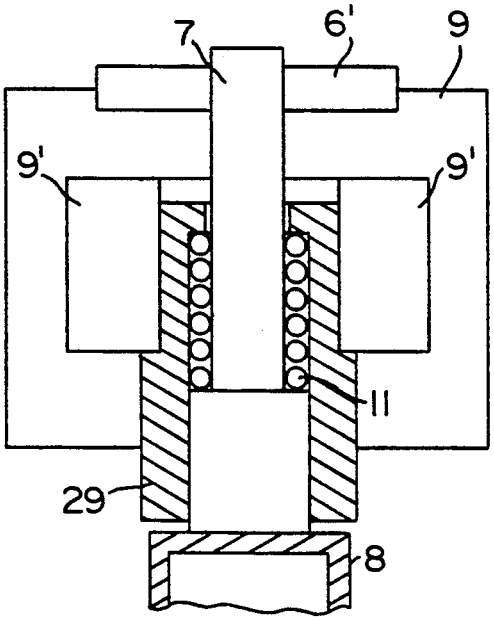

ELECTROMOTIVE STAPLER

BACKGROUND OF THE INVENTION

The present invention relates to a stapler which binds together papers with a staple, and more particularly to a stapler which is driven by an electric motor.

In a conventional electromotive stapler, in order to minimize the load of the motor, a paper holder is not provided. The function of a paper holder is to hold the papers to be bound tightly around the point at which the staple is struck. Without the holder, however, the staple is inclined with respect to the striking block due to paper displacement. This results in binding failure, especially when the papers are thick. To prevent such failure, the striking force of the striking block and, therefore, the power of the motor is increased.

SUMMARY OF THE INVENTION

An electromotive stapler is provided with a paper holder to press down the area surrounding the point at which the staple is struck. In this manner, more sheets of paper are capable of being bound without increasing the power of the motor. The pressing power of the paper holder is generated by the pushing motion of a push rod which is generated by a coil spring compressed by the motion of the striking block.

BRIEF DESCRIPTION OF THE DRAWINGS

FIG. 3 (*b*) is a front view of the insertion case which is illustrated by FIG. 3(*a*).

FIG. 4(*b*) is a front view of the staple case.

FIG. 5(*b*) is a plan view of the assembled staple case and insertion case which is illustrated in FIG. 5 (*a*) .

FIG. 6 is a perspective view of the electromotive stapler according to an exemplary embodiment of the present invention.

FIG. 7 is a perspective view of a striking block according to an exemplary embodiment of the present invention.

FIG. 8(*a*) and 8(*b*) show a push rod fixed onto a striking block.

FIG. 9 shows a push rod pushing a paper holder.

DETAILED DESCRIPTION OF THE INVENTION

An example of an electromotive stapler according to the present invention is explained below with reference to the drawings.

Figure 1:
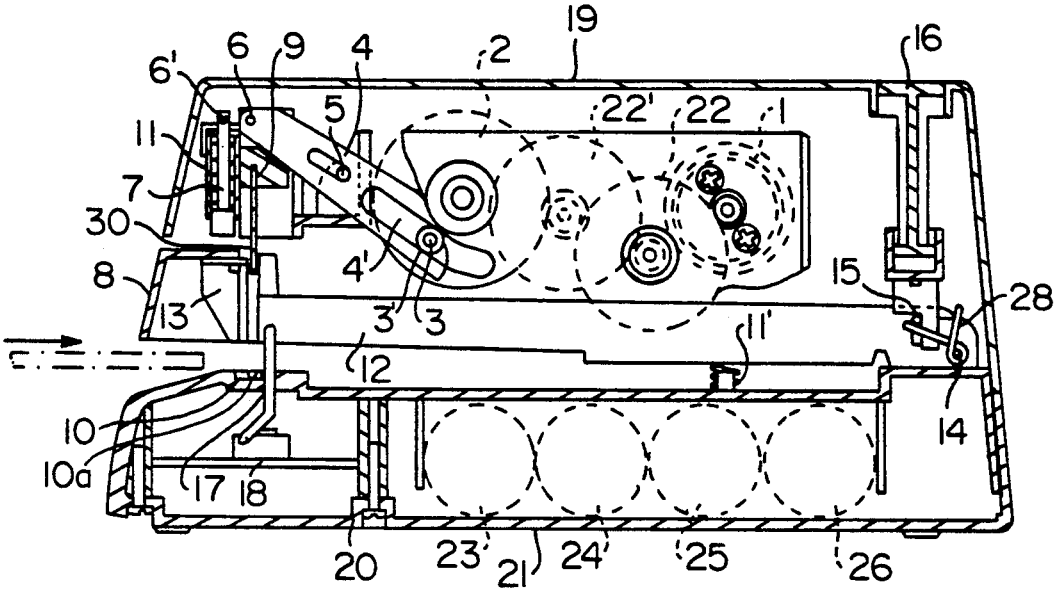
FIG. 1 is a sectional view of an electromotive stapler according to an exemplary embodiment of the present invention.
Figure 2:
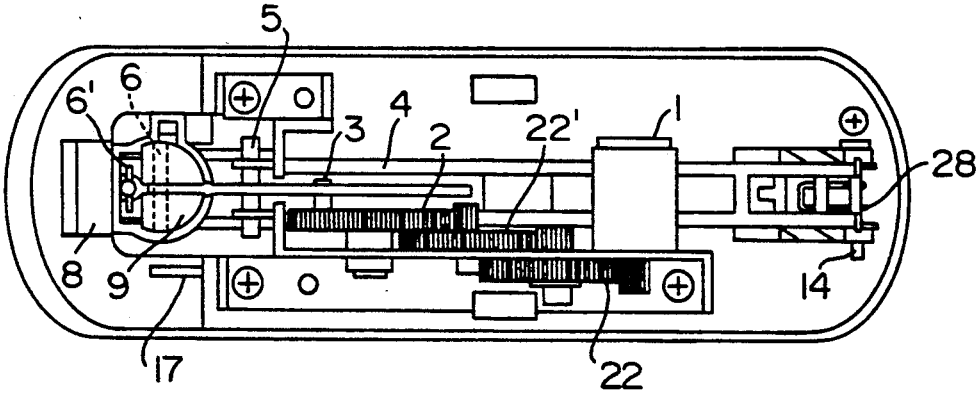
FIG. 2 is a plan view of an electromotive stapler with the cover removed according to an exemplary embodiment of the present invention.

FIG. 1, FIG. 2 and FIG. 6 show an example of a stapler according to the present invention. The driving torque of a motor 1 is transmitted to a driving gear 2 via intermediate gears 22 and 22'. The driving gear 2 is provided on its side with a boss 3 having a rotation-free ring 3' on the periphery. Boss 3 is inserted into a slide slot 4' of a coupling rod 4. The coupling rod 4 is fastened to the main frame by a fulcrum shaft 5. A striking block 9 is attached to the end of the coupling rod 4 through a hole 6, to move reciprocally in the collar of the main frame by rotation of motor 1.

FIG. 7 is a perspective view of the striking block 9, which has projections 9' on the front surface, and a staple striking blade 30 on the bottom surface. The striking block 9 is further, as shown in FIG. 8, provided with a push rod 7 by the projections 9'. As shown in FIG. 8(*a*) and FIG. 8(*b*), the striking block 9 is provided with a projections 9' having a push rod case 29 for the push rod 7 which is pierced by a pin 6' and surrounded by a coil spring.

The push rod 7 being held on the striking block 9 as the pin 6' and a push rod case 29 press the projections 9' therebetween by the force of a spring 11, moves downwards, as the striking block 9 moves downwards, to touch a paper holder 8. As shown in FIG. 9, 9 moves downwards, to touch a paper holder 8. As shown in FIG. 9, while the striking block 9 moves down, the push rod 7 remains at the initial place, and the spring 11 is further compressed, so that, the push rod 7 presses the papers through the paper holder 8. That is, the pressure with which the push rod 7 presses the paper holder 8 is obtained by the compression of the coil spring 11. A staple bending plate 10 is provided with a staple bending groove 10*a* for bending the end of a staple.

Figure 3A:
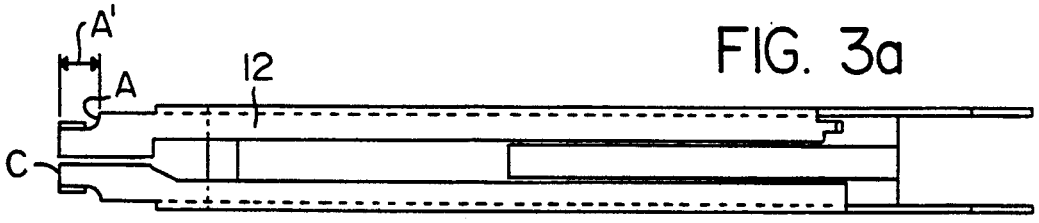
FIG. 3 (*a*) is a plan view of an insertion case according to an exemplary embodiment of the present invention.
Figure 3B:
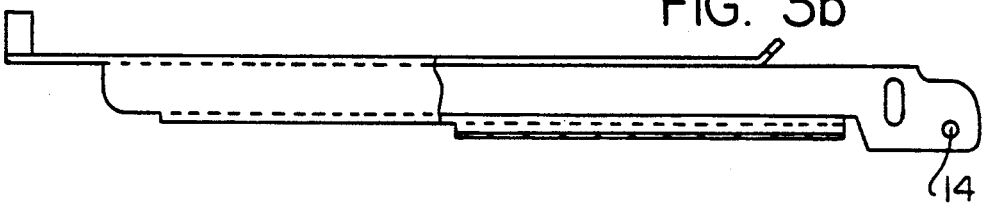
Figure 4A:
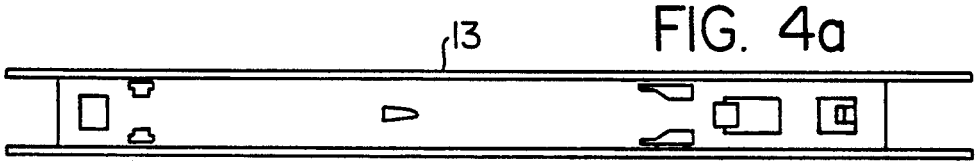
FIG. 4(*a*) is a plan view of a staple case according to an exemplary embodiment of the present invention.
Figure 4B:
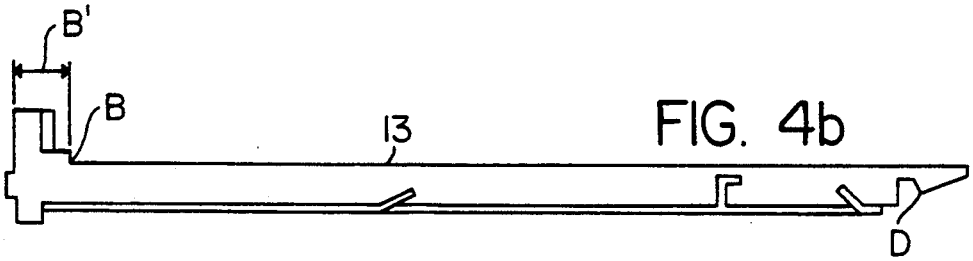
Figure 5A:
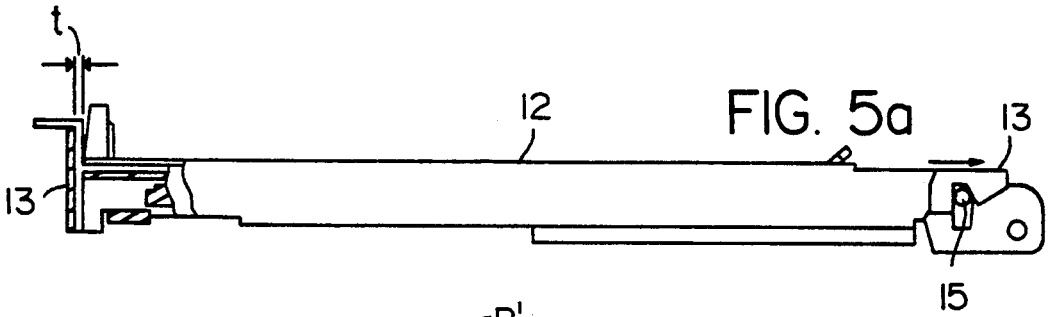
FIG. 5(*a*) is a side view of a staple case and an insertion case which has been assembled.
Figure 5B:
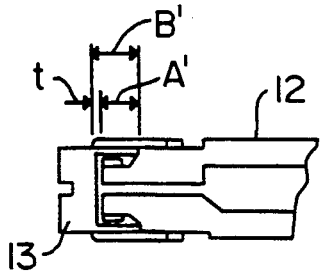

In FIG. 1 and FIG. 3, an insertion case 12 is held by the main frame so as to be rotation-free around a fulcrum 14. As shown in FIG. 1 and FIGS. 4(*a*) and 4(*b*), a staple case 13 is equipped with a paper holder 8. The staple case 13 is inserted slidingly into the insertion case 12, and is supplied with staples while the staple case 13 is drawn from the insertion case 12. In FIGS. 5(*a*) and 5(*b*) is shown the staple case 13 at the innermost part of the insertion case 12. The B surface (FIG. 4(*b*)) of the staple case 13 touches on the A surface (FIG. 3*a*) of the insertion case 12 tightly. Binding of papers is carried out under this condition. A pin 15 coupling the staple case 13 and the insertion case 12 is given a force of upward direction by an end of the spring 28 (FIG. 1), and this upward-directed force works, via D part (FIG. 4) of the staple case 13, to the direction of the arrow i.e. to the direction as to increase the contacting pressure between both parts.

In FIG. 5 (*b*), the narrow space t between both parts is called a stapling gap. The staple striking blade 30 of the striking block 9 moves through in this stapling gap to strike the staples into the papers.

As shown in FIG. 5 (*b*) , one of the sides of the stapling gap (right side) is made by a part of the insertion case 12, the other side of the stapling gap (left side) is made by a part of the staple case 13.

The width t of the stapling gap is precisely determined by precisely manufacturing the distance A' and B'. A' and B' are the distance between the tightly contacted point of both above mentioned parts and each side of the stapling gap.

Returning to FIG. 1, the coupling of the staple case 13 and the insertion case 12 is released by pushing a release stick 16 to move the pin 15 downwards. The spring 28, as described above, pushes the pin 15 upward by the one end and pushes the staple case 13 to the left side by the other end, and, accordingly, the staple case 13 jumps out to the left as the coupling of the both parts is released, to be easily supplied with staples. The electromotive stapler is further provided with a switch lever 17, a printed circuit board 18 involving a control circuit to drive the motor 1, a cover 19, base plate 20, a battery cover 21 and batteries 23, 24, 25, 26. The operation of the stapler is explained below.

Initially, both the striking block 9 and the push rod 7 are at the top dead center. When the papers to be bound are pushed in, pressing the switch lever 17, the motor 1 rotates. The rotation of the motor 1 is transmitted to the driving gear 2 via the intermediate gear 22 and 22', the coupling rod 4 is driven by the boss 3, striking block 9 and push rod 7 moves down from the top dead center, and the push rod 7 pushes the paper holder to press the papers to be bound. The striking block 9 further goes down to push down the staple kept between the insertion case 12 and the staple case 13, so that, the end of the staple pierces through the papers to be bound and is bent by the staple bending groove 10*a* of the staple bending plate 10 to bind the papers. The motor 1, after rotating somewhat further, stops when the striking block 9 and push rod 7 are returned to the top dead center to open a microswitch (not shown).

What is claimed:

1. An electromotive stapler comprising:

an electric motor, a control circuit to drive the electric motor, a series of gears driven by the motor, a driving gear driven by the series of gears and having a boss on a side face thereof, a coupling rod having a slide slot through which said boss is inserted, a striking block coupled with the coupling rod moving reciprocally by rotation of the electric motor to strike a staple into a plurality of papers, a paper holder for holding the plurality of papers while the staple is struck into the plurality of papers, and a push rod linked with the striking block to press down said paper holder, wherein the push rod presses down in direct contact with said paper holder when the striking block is below a certain point and said push rod is separated from said paper holder when said striking block is not below said certain point.

2. An electromotive stapler according to claim 1, further comprising a switch lever to initiate rotation of the motor.

3. An electromotive stapler according to claim 2, wherein the switch lever is positioned so that the papers engage the switch lever.

4. The electromotive stapler according to claim 3, having a tightly contacted insertion case, a staple case, and a stapling gap which is formed between the tightly contacted insertion case and the staple case, the stapling gap having first and second sides, wherein the first side of the stapling gap is made by a part of the insertion case, and the second side of the stapling gap is made by a part of the staple case.

5. The electromotive stapler according to claim 1, having a tightly contacted insertion case, a staple case, and a stapling gap which is formed between the tightly contacted insertion case and the staple case, the stapling gap having first and second sides, wherein the first side of the stapling gap is made by a part of the insertion case, and the second side of the stapling gap is made by a part of the staple case.

6. An electromotive stapler according to claim 5, further comprising a coil spring that is compressed by the movement of the striking block, wherein the push rod presses the paper holder to apply a pressure that is given by the coil spring.

7. An electromotive stapler according to claim 1, further comprising a coil spring that is compressed by the movement of the striking block, wherein the push rod presses the paper holder to apply a pressure that is given by the coil spring.

8. An electromotive stapler according to claim 1, wherein the push rod presses down the paper holder at a point located at an outer side of the striking block.

9. An electromotive stapler comprising:

an electric motor, a control circuit to drive the electric motor, a series of gears driven by the motor, a driving gear driven by the series of gears and having a boss on a side face thereof, a coupling rod having a slide slot through which said boss is inserted, a striking block coupled with the coupling rod moving reciprocally by rotation of the electric motor to strike staple into a plurality of papers, a push rod linked with the striking block to press down a paper holder to press said plurality of papers, said paper holder coupled to an arm, wherein the push rod presses down in direct contact with said paper holder when the striking block is below a certain point and said push rod is separated from said paper holder when said striking block is not below said certain point, and a coil spring that is compressed by the movement of said striking block, wherein the push rod presses the paper holder to apply a pressure that is given by the coil spring.

* * * * *

UNITED STATES PATENT AND TRADEMARK OFFICE

CERTIFICATE OF CORRECTION

PATENT NO. : 5,330,086
DATED : July 19, 1994
INVENTOR(S) : Shigehiko Shimomura et al.

It is certified that error appears in the above-indentified patent and that said Letters Patent is hereby corrected as shown below:

Column 4, claim 9, line 39, after "strike" insert --a--.

Signed and Sealed this

Twenty-seventh Day of December, 1994

*Attest:*

Bruce Lehman

BRUCE LEHMAN

*Attesting Officer*

*Commissioner of Patents and Trademarks*